US006250899B1

(12) United States Patent
Lee et al.

(10) Patent No.: US 6,250,899 B1
(45) Date of Patent: Jun. 26, 2001

(54) ROTARY COMPRESSOR

(75) Inventors: Sang Yong Lee, Seoul; Song Choi, Anyang, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/021,562

(22) Filed: Feb. 10, 1998

(30) Foreign Application Priority Data

Feb. 12, 1997 (KR) ..... 97-4047

(51) Int. Cl.[7] ..... F04C 18/00
(52) U.S. Cl. ..... 418/63; 418/83; 418/92
(58) Field of Search ..... 418/63, 83, 92, 418/139

(56) References Cited

U.S. PATENT DOCUMENTS

| | | | | |
|---|---|---|---|---|
| 669,461 | * | 3/1901 | Kochendarfer et al. | 418/139 |
| 902,762 | * | 11/1908 | Risley | 418/139 |
| 1,361,343 | * | 12/1920 | Marion | 418/139 |
| 3,813,193 | * | 5/1974 | Rinehart | 418/63 |
| 3,923,431 | * | 12/1975 | Abbey | 418/139 |
| 4,592,705 | * | 6/1986 | Ueda et al. | 418/63 |
| 4,629,403 | * | 12/1986 | Wood | 418/63 |
| 4,664,608 | * | 5/1987 | Adams et al. | 418/63 |
| 4,669,963 | * | 6/1987 | Ishihara et al. | 418/65 |
| 5,007,813 | * | 4/1991 | Da Costa | 418/63 |
| 5,842,847 | * | 12/1998 | Riegger et al. | 418/63 |
| 5,951,273 | * | 9/1999 | Matsunaga et al. | 418/63 |

FOREIGN PATENT DOCUMENTS

| | | | | |
|---|---|---|---|---|
| 49-77209 | | 7/1974 | (JP) . | |
| 58-62192 | | 4/1983 | (JP) . | |
| 59-14245 | | 1/1984 | (JP) . | |
| 61-130791 | | 6/1986 | (JP) . | |
| 361197791 | * | 9/1986 | (JP) | 418/63 |
| 0271985 | * | 11/1987 | (JP) | 418/63 |
| 0189683 | * | 8/1988 | (JP) | 418/63 |
| 0185292 | * | 8/1991 | (JP) | 418/63 |
| 405157073 | * | 6/1993 | (JP) | 418/63 |
| 405240178 | * | 9/1993 | (JP) | 418/63 |
| 405240179 | * | 9/1993 | (JP) | 418/63 |

* cited by examiner

*Primary Examiner*—Thomas Denion
*Assistant Examiner*—Thai-Ba Trieu

(57) ABSTRACT

A rotary compressor includes a cylinder having a slot, an eccentric shaft disposed in the cylinder, a roller formed around the shaft, a vane inserted into the slot and having grooves on its surface, and a sealing material inserted into the grooves. The sealing material prevents leakage and influx of gas through a gap between the cylinder and the vane, improving the efficiency of a rotary compressor.

18 Claims, 7 Drawing Sheets

ROTARY COMPRESSOR

BACKGROUND OF THE INVENTION

The present invention relates to a rotary compressor, and more particularly to a rotary compressor equipped with sealing means in a vane for preventing leakage and influx of gas through a gap between a cylinder and the vane.

In a conventional rotary compressor for refrigeration, as shown in FIG. 1, the inside space of a cylinder 1 is divided into an inlet space and a compression space by a roller 3 and a vane 6. Refrigerant gas in the compression space is compressed by the roller 3 and the vane 6 operating as a movement of an eccentric shaft 2, while new refrigerant gas continually gets into the inlet space through an inlet port 5. The compressed gas in the compression space is discharged to the outside space of the cylinder 1 through an outlet port 4, whereby pressure between the cylinder and a case (not illustrated) becomes high. The case isolates the outside space of the cylinder 1 from the atmosphere. The vane 6 moves up and down in a slot 8 and is pushed onto the roller 3 by the outside pressure of the cylinder 1 and by the spring 7 connected to the upper side of the vane 6. The outside pressure of the cylinder is higher than the inside pressure of the cylinder except when the gas is discharged into the outside of the cylinder.

In the above-mentioned rotary compressor, as shown in the FIG. 2, the pressure difference between the inside and outside of the cylinder is liable to cause leakage of the inside gas into the outside of the cylinder and influx of the outside gas into the inside of the cylinder through a gap between the vane and the cylinder, worsening the efficiency of the rotary compressor.

SUMMARY OF THE INVENTION

An object of the present invention is to provide an improved rotary compressor by preventing the leakage and influx of gas through a gap between the cylinder and the vane.

The present invention provides a rotary compressor which comprises a cylinder having a slot, an eccentric shaft disposed in the inside of the cylinder, a roller formed around the eccentric shaft, a vane inserted into the slot and having at least one groove on surface thereof, and sealing means inserted into the groove. The sealing means is made of ceramic, fluorocarbon polymer or metal such as aluminum, brass, or iron.

DETAILED DESCRIPTION OF THE INVENTION

Preferable embodiments of the present invention are described accompanying drawings hereinafter.

Figure 1:
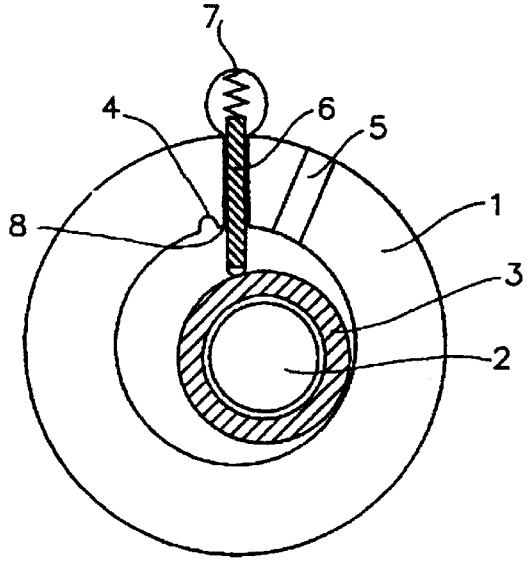
FIG.1 PRIOR ART
FIG. 1 and FIG. 2 are views showing a conventional rotary compressor.
Figure 2:
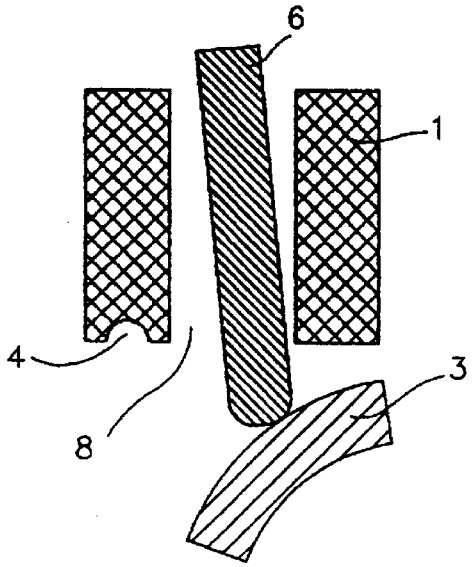
FIG.2 PRIOR ART
Figure 3A:
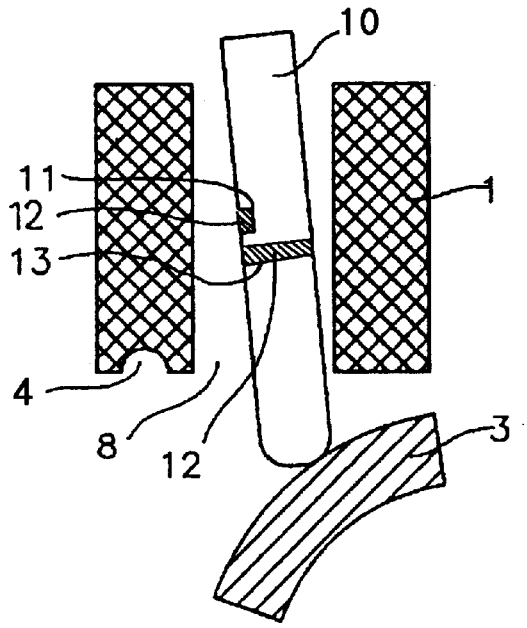
FIG. 3*a* and FIG. 3*b* are views showing a rotary compressor of the present invention.
Figure 3B:
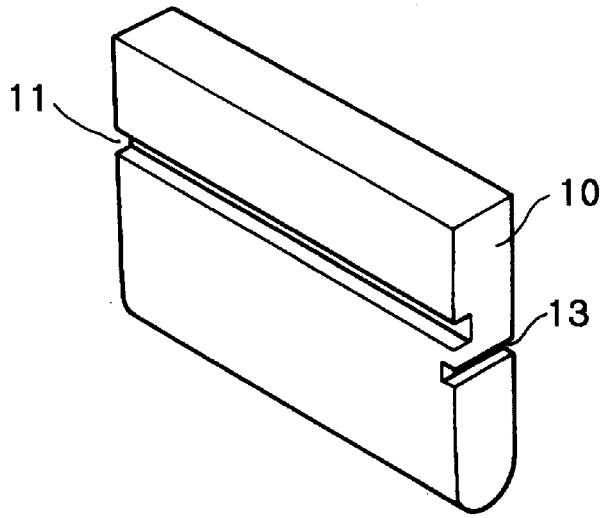

FIGS. 3*a*, 3*b* are views showing a vane part of a rotary compressor according to the invention, and the other parts are not illustrated in this figures and are described referring to FIG. 1. As shown in the figures, the rotary compressor of the invention comprises a cylinder 1 having a slot 8, an inlet port 5 and an outlet port 4, a vane 10 which is inserted in the slot 8 and has a side groove 11 and an end groove 13, a roller 3 which separates the inlet space from the outlet space with the vane 10, an eccentric shaft 2 operating the vane 10 and the roller 3, a vane spring 7 connected to an upper side of the vane 10, and sealing means 12 inserted into the side and end grooves 11, 13. The sealing means is formed to prevent leakage and influx of refrigerant gas through a gap between the vane 10 and the cylinder 1, and is made of ceramic, fluorocarbon polymer or metal such as aluminum, brass, or iron. And the size of the sealing means is determined to be smaller than the grooves 11, 13 so that it is not fixed to the grooves 11, 13.

Figure 4:
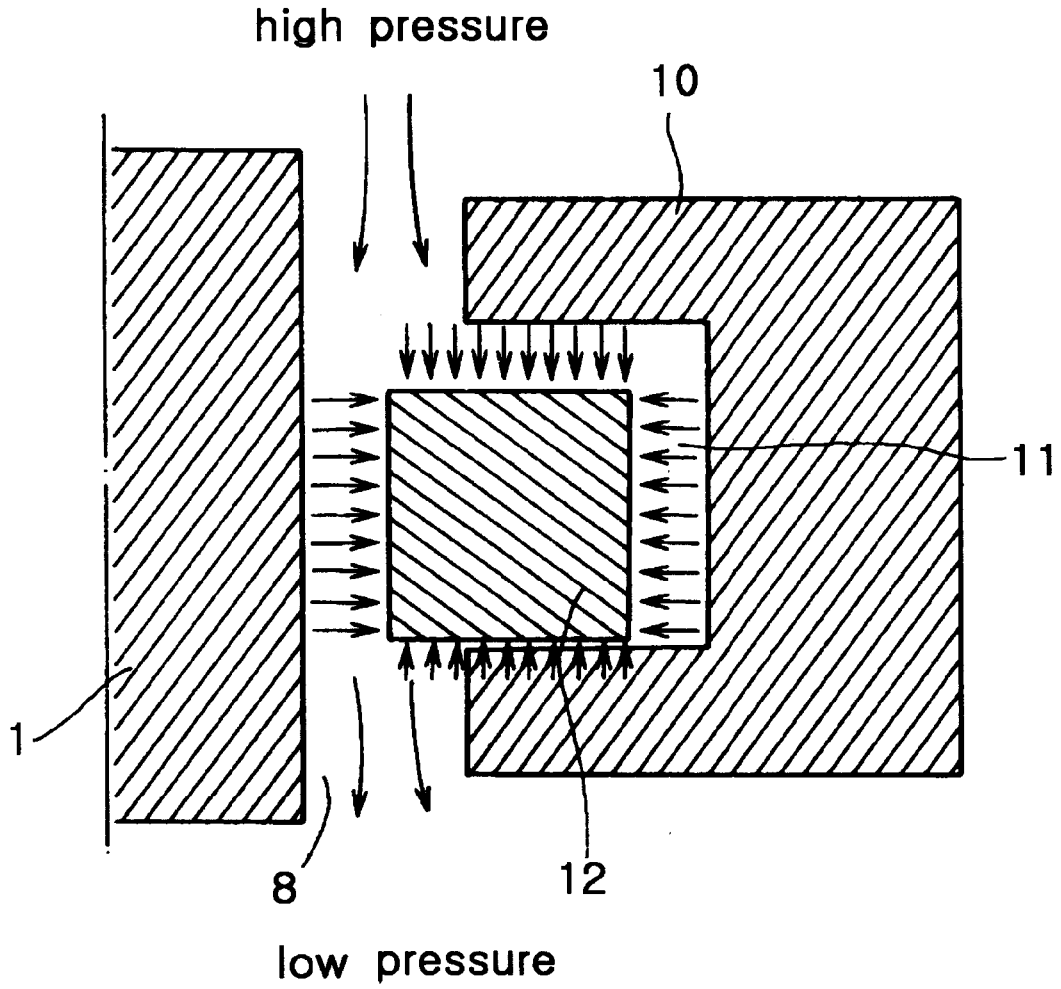
FIG. 4 is a view for explaining the operation of the rotary compressor according to the present invention.

FIG. 4 is a view showing the operation of the inventive rotary compressor when the outside pressure of the cylinder is higher than the inside pressure of the cylinder. As shown in the figures, the outside gas is forced into the slot 8 by the pressure difference pushing the sealing means 12 toward the inside of the cylinder 1, and flows into the grooves 11 pushing out the sealing means 12 until equal are both pressures of the back and front of the sealing means 12. Consequently, the outside gas is prevented from flowing into the inside of the cylinder.

The same principle reasonably applies to the case that the inside pressure of the cylinder is higher than the outside pressure of the cylinder.

When the vane 10 is in contact with the cylinder 1, the sealing means 12 gets into the groove 12, removing the problem of abrasions.

Figure 5A:
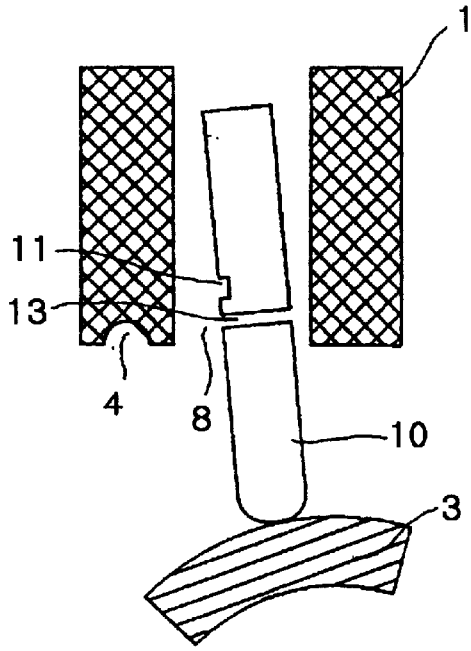
FIG. 5*a* and FIG. 5*b* are views showing the movement of a vane of the rotary compressor according to the present invention.
Figure 5B:
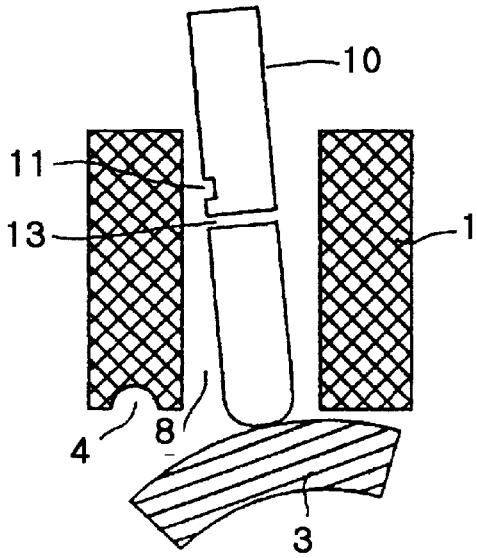

As shown in the FIGS. 5*a*, 5*b*, the position of the grooves 11, 13 is determined so that they cannot be out of the slot 8 in any action.

Figure 6A:
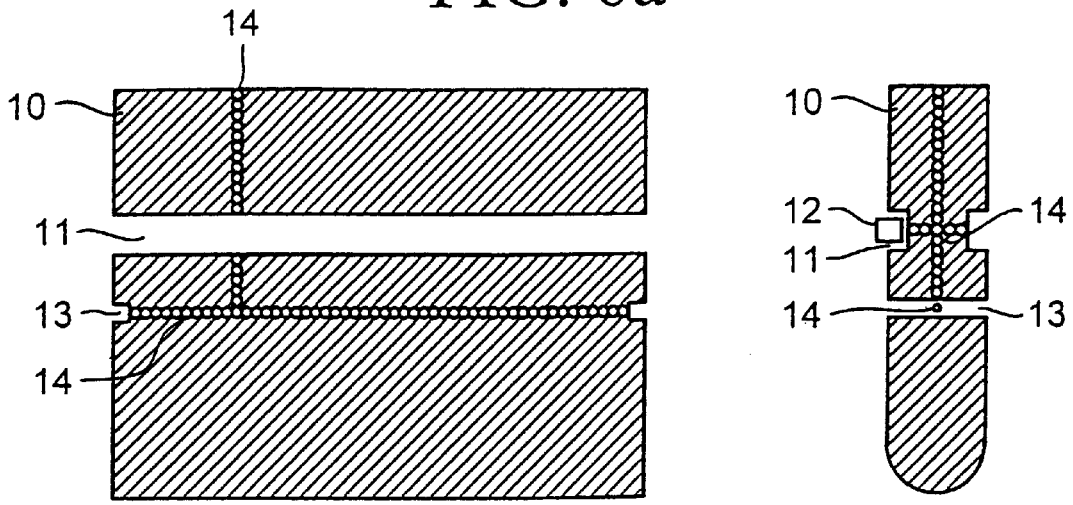
FIG. 6*a* and FIG. 6*b* are sectional and end views showing a vane of an embodiment according to the present invention.
Figure 6B:
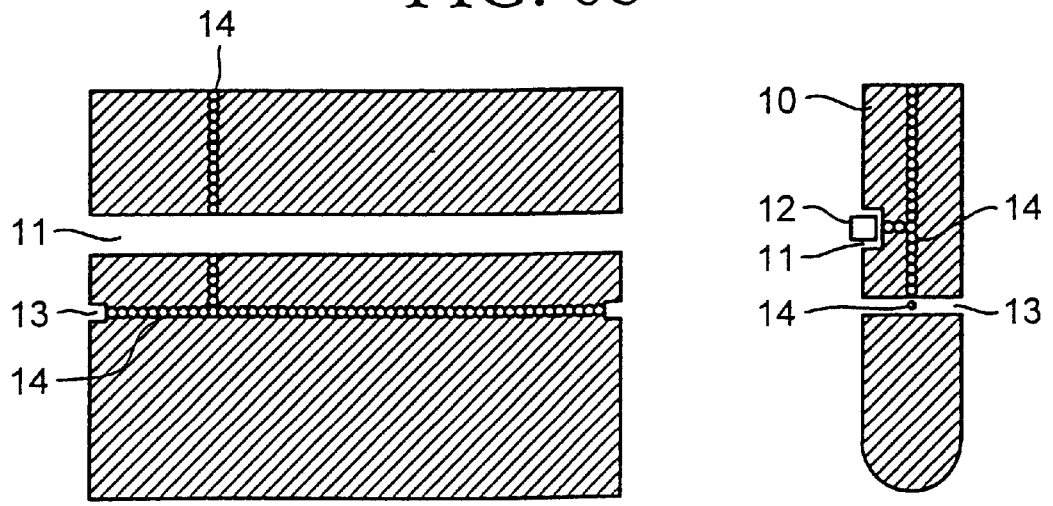

The FIGS. 6*a* and 6*b* are views showing a vane of another rotary compressor. In this figure, a sealing means is not illustrated with ease.

As shown in the figures, the vane 10 has both end grooves 13, both side grooves 11, and oil pressure hole 14. The oil pressure hole is channeled to the grooves 11, 13 for adding oil pressure to the sealing means 12.

The FIG. 7*s* are views showing various embodiments according to the invention.

Figure 7A:
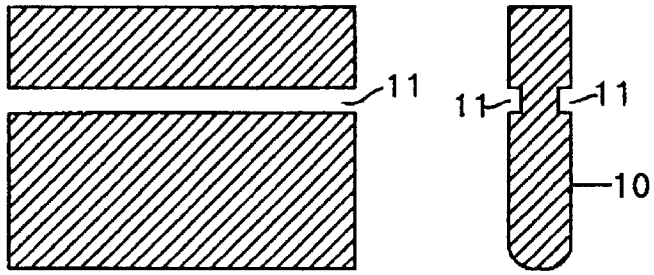
FIG.7*a* to FIG. 7*f* are sectional and end views showing various vanes of the rotary compressor according to the present invention.

A vane 10 as shown in FIG. 7*a* has both side grooves 11.

Figure 7B:
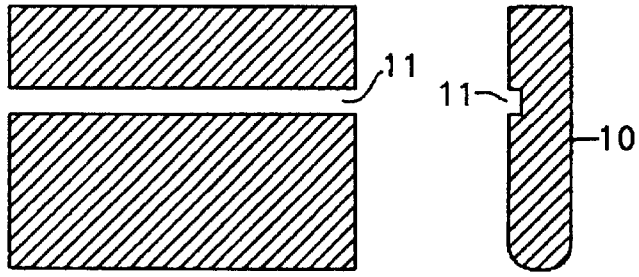

A vane 10 as shown in FIG. 7*b* has one side groove 11.

Figure 7C:
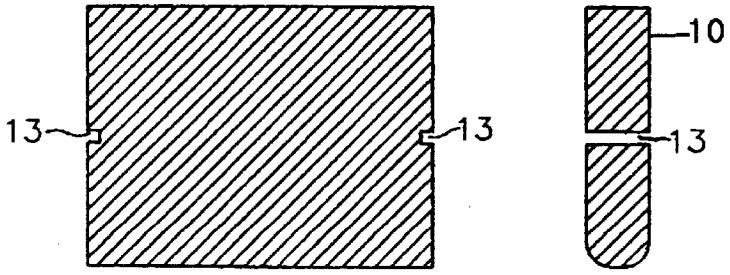

A vane 10 as shown in FIG. 7*c* has both end grooves 13.

Figure 7D:
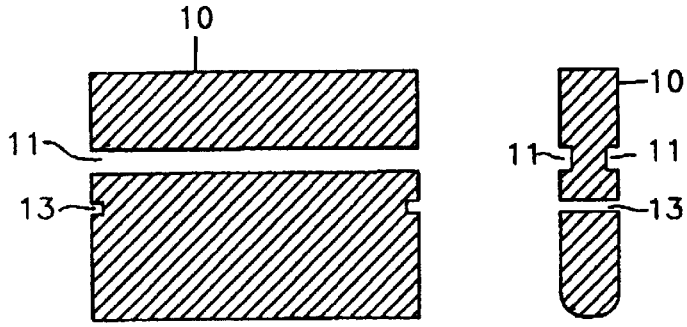

A vane 10 as shown in FIG. 7*d* has both side grooves 11 and both end grooves 13.

Figure 7E:
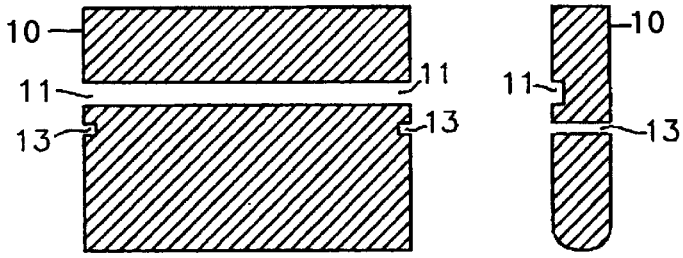

A vane 10 as shown in FIG. 7*e* has one side groove 11 and both end grooves 13.

Figure 7F:
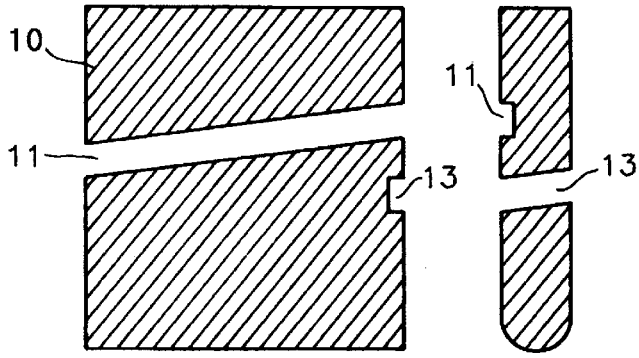

A vane 10 as shown in FIG. 7*f* has one oblique side groove 11 and one oblique end groove 13.

In the inventive embodiments as described above, prevented is the leakage and influx of gas through a gap between the vane and the cylinder by the sealing means, improving the efficiency of a rotary compressor.

The invention may be embodied in other specific forms without departing from the spirit or essential characteristics thereof. The present embodiments are therefore to be considered in all respects as illustrative and not restrictive, the appended claims rather than by the foregoing description and all changes which come within the meaning and the range of equivalency of the claims are therefore intended to be embraced therein.

What is claimed is:

1. A rotary compressor, comprising:

a cylinder having a slot;

an eccentric shaft disposed in the cylinder;

a roller formed around the eccentric shaft;

a vane, with a side surface and an end surface, disposed in the slot and having at least one groove, said groove being on at least one of the side surface and the end surface thereof, and said vane further having an oil pressure hole channeled to said groove; and a solid sealing means inserted into the groove.

2. A rotary compressor according to claim 1, wherein the size of the sealing means is smaller than the size of the groove.

3. A rotary compressor according to claim 1, wherein the sealing means includes at least one of a ceramic, a fluorocarbon polymer, aluminum, brass and iron.

4. The rotary compressor of claim 1, wherein said sealing means floats within said groove.

5. A vane structure for a rotary compressor, comprising:

a vane with a side surface and an end surface, said vane having at least one side groove on said side surface and at least one end groove on said end surface such that said side groove and said end groove are not aligned;

an oil pressure hole channeled to at least one of said side and end groves; and a solid sealant inserted into at least one of said side and end grooves.

6. The vane structure of claim 5, wherein said side groove is oblique.

7. The vane structure of claim 5, wherein said end groove is oblique.

8. The vane structure of claim 5, wherein there is only one side groove.

9. The vane structure of claim 5, wherein there is only one end groove.

10. The vane structure of claim 5, wherein said sealant includes at least one of a ceramic, a fluorocarbon polymer, aluminum, brass and iron.

11. The vane structure of claim 5, wherein said sealant floats within said groove.

12. A vane structure for a rotary compressor, comprising:

a vane with a side surface and an end surface, said vane having at least one of a side groove on said side surface and an end groove on said end surface, and said vane further having an oil pressure hole channeled to said groove; and a solid sealant inserted into the groove.

13. The vane structure of claim 12, wherein there are both said side groove and said end groove.

14. The vane structure of claim 13, wherein said side groove and said end groove are not aligned.

15. The vane structure of claim 12, wherein said side groove is oblique.

16. The vane structure of claim 12, wherein said end groove is oblique.

17. The vane structure of claim 12, wherein said sealant includes at least one of a ceramic, a fluorocarbon polymer, aluminum, brass and iron.

18. The vane structure of claim 12, wherein said sealing means floats within said groove.

* * * * *